US005203721A

United States Patent [19]

Buck

[11] Patent Number: 5,203,721

[45] Date of Patent: Apr. 20, 1993

[54] MOLDED PLASTIC COAXIAL CABLE SIDE TAP CONNECTOR

[75] Inventor: Steven K. Buck, Buda, Tex.

[73] Assignee: W. L. Gore & Associates, Inc., Newark, Del.

[21] Appl. No.: 939,287

[22] Filed: Sep. 1, 1992

[51] Int. Cl.[5] ..... H01R 17/04

[52] U.S. Cl. ..... 439/581; 439/620

[58] Field of Search ..... 439/578-585, 439/675, 98, 99, 92, 394; 29/828, 854, 856, 867; 174/78, 88

[56] References Cited

U.S. PATENT DOCUMENTS

| | | | |
|---|---|---|---|
| 3,757,269 | 9/1973 | Baumgartner et al. | 439/99 |
| 4,164,621 | 8/1979 | Silva | 29/828 |
| 4,407,065 | 10/1983 | Gray | 29/828 |
| 4,472,216 | 9/1984 | Hogenhout et al. | 29/854 |
| 4,733,464 | 3/1988 | Gregorac | 29/828 |
| 4,746,307 | 5/1988 | Joly et al. | 439/394 |
| 4,850,895 | 7/1989 | Arai et al. | 439/394 |

FOREIGN PATENT DOCUMENTS

| | | | |
|---|---|---|---|
| 7417237 | 12/1975 | France | 29/828 |
| 513537 | 11/1971 | Switzerland | 29/828 |

*Primary Examiner*—David L. Pirlot
*Attorney, Agent, or Firm*—Gary A. Samuels

[57] ABSTRACT

A coaxial cable side tap assembly of a coaxial cable with pins separately attached to the cable center conductor and braided sheath for connecting to a branch cable or an integrated circuit or transducer microchip and processes for manufacture thereof.

6 Claims, 3 Drawing Sheets

MOLDED PLASTIC COAXIAL CABLE SIDE TAP CONNECTOR

FIELD OF THE INVENTION

The invention relates to side tap connector assemblies for tapping into a coaxial electric signal cable at any point for attachment of integrated circuit chips and to processes for assembling the connector, coaxial cable, and chip.

BACKGROUND OF THE INVENTION

In the provision of wiring systems carrying voice, electronic data, and/or electrical power between separate buildings, communication or data equipment and networks, or work stations within a building, it is frequently needed to splice or branch coaxial electric cables. Splicing is usually done by tapping into a coaxial cable along its length at a convenient point for branching. This can become tedious, complicated, and time consuming where the tap connectors are complicated and/or bulky and require special tools and skills for installation.

Several methods are currently used to tap a coaxial cable. One method is to cut the coaxial cable, terminate each end with a connector, and connect each connector to a tee connector. This method often gives a bulky and labor intensive connection. In a second method, the jacket, shield, and insulation are stripped from a short section of coaxial cable. The exposed center conductor is soldered to the exposed center conductor of a second coaxial cable, the shields connected by jumper wire, and the splice covered with insulation. This method is usually labor intensive, and the mechanical integrity of the coaxial cable is reduced since the braided shield, a primary strength member, has been cut.

A third method utilizes coaxial solder sleeves to tie in a third coaxial cable after the coaxial cable has been cut in two. Poor electrical characteristics and poor mechanical strength usually characterize the product of this method.

One may also cut and strip a coaxial cable and solder each center conductor to a pin on a small printed circuit (PC) board. The braids are soldered to pads on the board and onto a metal cover. The inside of the cover is incapsulated in insulation. The two pins protruding from the rear side of the PC board may connect to a branch coaxial cable. This product has good electrical properties, but only fair mechanical properties, and is usually a bit bulky.

A frequently used method is a saddle clamp device attached to a coaxial cable from which pointed contacts pierce the cable to contact the shield and the center conductor. Unreliable contact is often a problem with this method.

SUMMARY OF THE INVENTION

The invention comprises a coaxial cable side tap assembly and processes for its manufacture and an assembly of the cable and tap with an integrated circuit chip.

The coaxial cable comprises an electrically conductive center conductor surrounded by insulation (dielectric), which is preferably expanded polytetrafluoroethylene (ePTFE). The insulation is surrounded by a braided electrically conductive sheath and optionally a protective polymer jacket around the shield.

The assembly of the invention is prepared by removing a short section of insulation from an insulated electric conductor. A molded plastic cap of the same or matching cylindrical curvature as the insulation is fitted in place over the exposed center conductor. The molded plastic cap has imbedded in it and penetrating perpendicularly through its surfaces a conductive contact pin of a length to contact the center conductor of the cable when the molded plastic cap is in place fitted against the insulation of the cable. The pin is soldered to the center conductor and the cavity in the insulation around the insulation, the center conductor, and the pin soldered thereto filled with insulation, preferably of the same properties as the insulation of the cable. The cap also has a small shaped hump of plastic, such as conical, for example, molded on its outer surface around the protruding contact pin. The hump of plastic serves to pass conductive braid around it and the conductive pin held therein so the braid does not touch the pin when the braid is later applied to the cable. An additional short conductive pin is also affixed to or imbedded in the molded polymer cap near the center conductor contact pin for contacting electrically the conductive braid of the cable. A conductive plating on the polymer cap may surround the short conductive pin to aid in good contact with the braid.

A braided electrically conductive sheath is now braided around the molded cap and insulation to provide a conductive shielding for the cable which is in electrical contact with the short pin and/or conductively plated area surrounding the pin. The braided sheath holds the molded plastic cap firmly in place over the cable insulation and helps to anchor the side tap in place.

A protective plastic sheath may be optionally applied around the braided sheath as for other forms of the cable above.

The above described side tap may be connected to a small integrated circuit microchip or transducer to form an integral part of a cable side tap microchip assembly under a plastic outer protective jacket covering the entire assembly. Optionally, the microchip under the jacket may have means provided for connection outside the assembly and may have a thin layer of insulation inserted between the microchip or transducer and the conductive braid surrounding the insulation and top and/or bottom portions of a conductive cap.

DETAILED DESCRIPTION OF THE INVENTION

The assemblies of the invention and the processes for its manufacture are now described with reference to the drawings to more fully and carefully delineate the components of the assembly and how they are assembled together by the processes of the invention.

Figure 1:
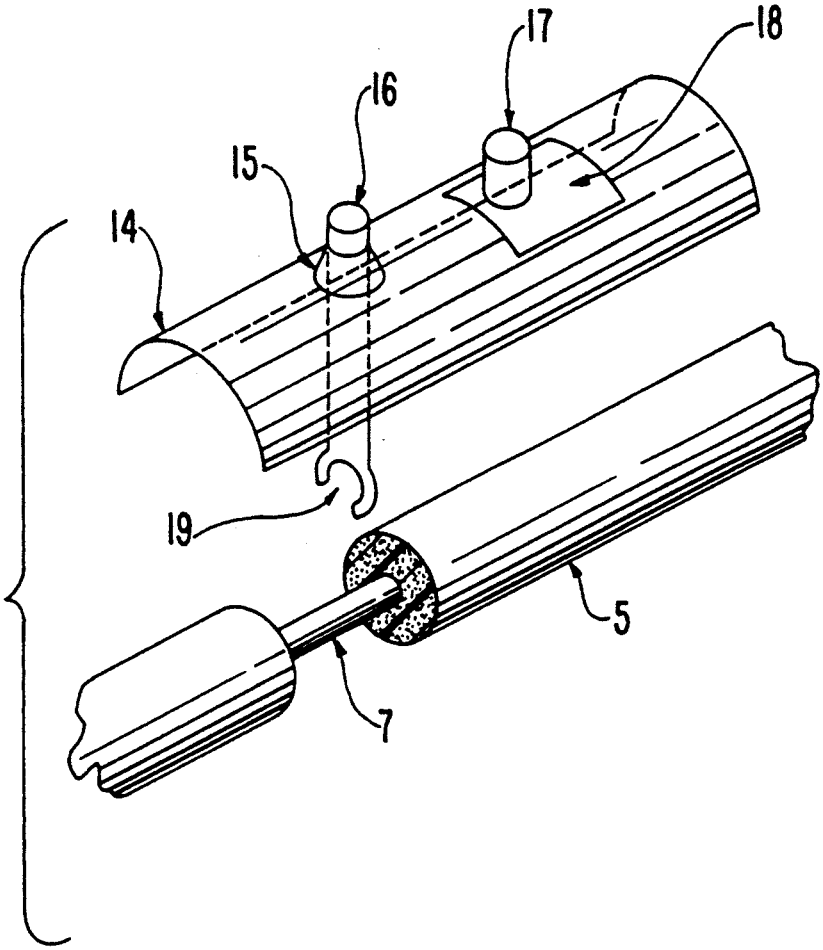
FIG. 1 is a blown up perspective view of a molded plastic cap of the invention with pins affixed for contacting the center conductor of a cable on a braided shield (not shown).

FIG. 1 is a blown up perspective diagram of a molded plastic cap 14 in proper spatial relationship to an insulated electric signal conductor 7 with a short section of insulation 5 removed. Conductive contact pin 16 is held in place in the wall of cap 14 by a shaped hump 15 of the molded plastic and extends downwardly toward conductor 7 with which it makes contact at notch 19 when cap 14 rests in place against insulation 5. Pin 16 is soldered in place on conductor 7 at notch 19 and the cavity surrounding the soldered contact filled with insulation, such as a liquid epoxy compound or a moldable form of the same insulation as 5 or its equivalent in dielectric constant.

A conductive contact pin 17 is also affixed to or imbedded in the wall of cap 14 and may have a plated-on conductive area 18 to aid pin 17 in making conductive contact with braided shielding to ground the cable.

Figure 2:
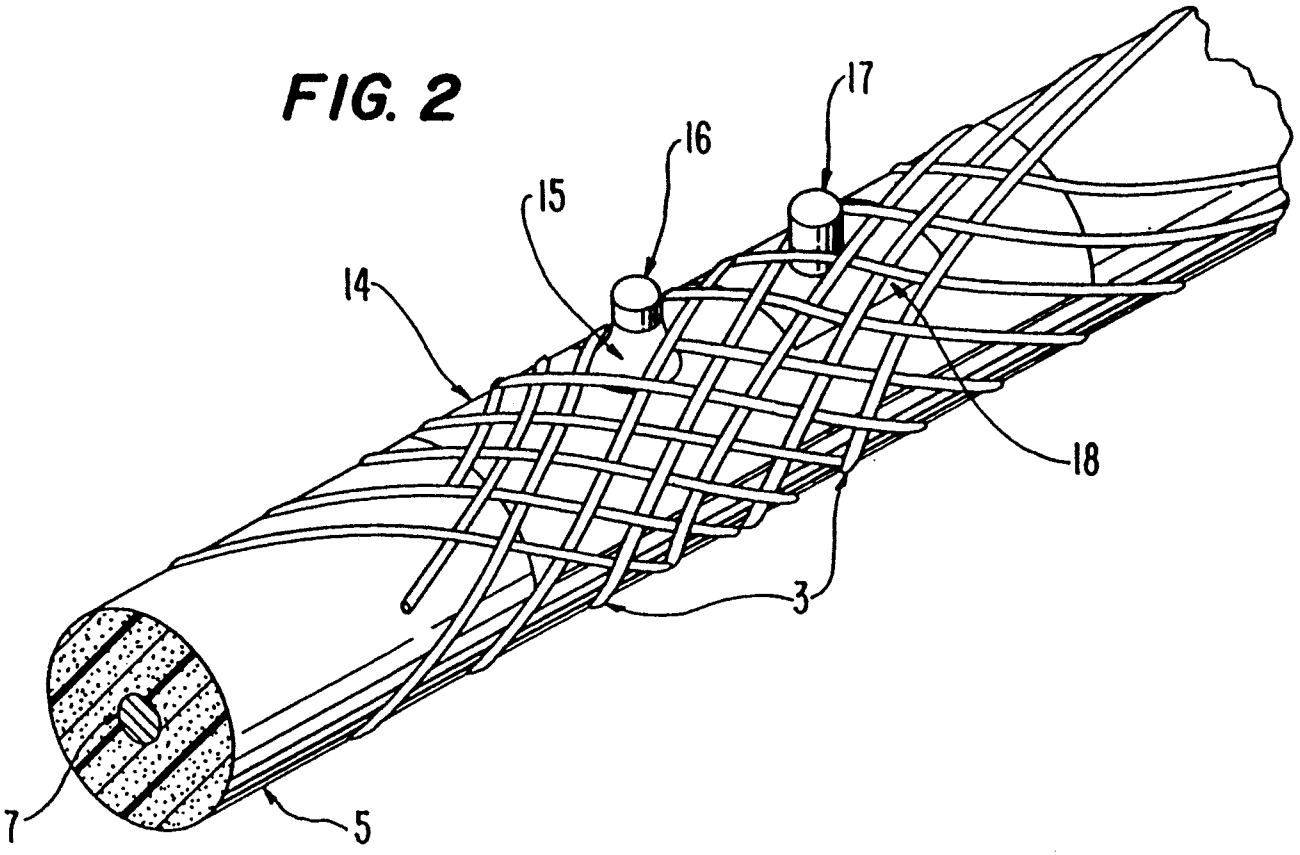
FIG. 2 is a perspective view of a molded plastic cap of the invention in place on a cable with braided shield around the ends of the contact pin.

FIG. 2 is a perspective view of a molded cap 14 in place on insulation 5 above and in contact with conductor 7. Strands of braided shielding 3 have now been braided around the insulated conductor and cap 14 by a standard cable braiding apparatus and process. Strands of braid 3 do not contact pin 16 as they flow around shaped hump 15 of cap 14, but do form an electrical contact with pin 17 with aid of plated-on conductive metal area 18. Molded plastic cap 14 may be formed into a cylindrically curved shape to match the curvature of the insulation to which it is to be mated and may be formed from any of the known thermoplastic materials commonly useful for such parts, such as polyvinyl chloride, polyethylene, polypropylene, polyamide, or polyester, for example.

Figure 3:
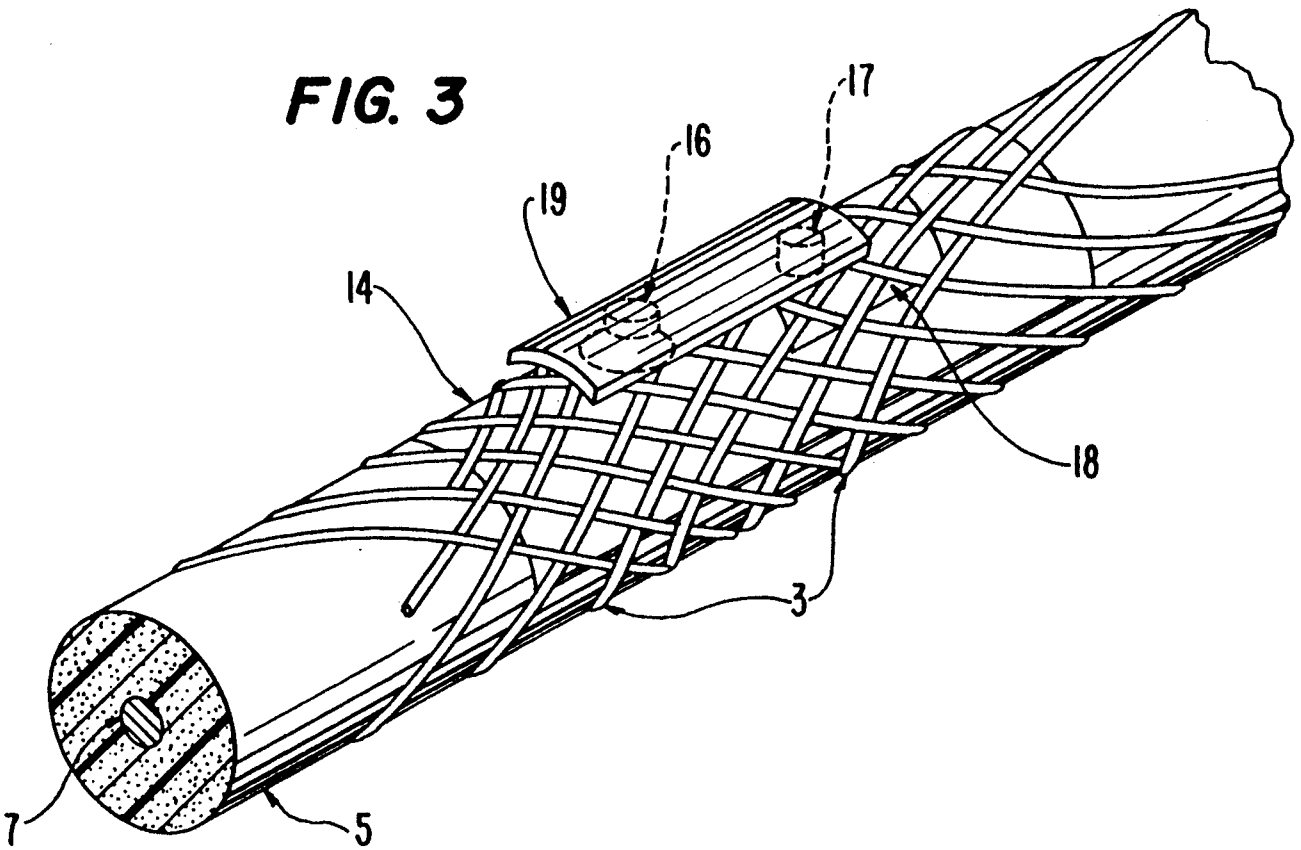
FIG. 3 is a perspective view of a cable of FIG. 9 having an integrated circuit chip electrically connected to the cable across pins 16 and 17.

FIG. 3 shows a cable of FIG. 9 upon which integrated circuit chip 19 has been affixed in electrical contact with pins 16 and 17 and thence to the center conductor 7 and the conductive braid shielding 3.

The integrated circuit chip 19 may be a central processor wafer of about 0.2 inch by about 0.2 inch or less in dimensions. Such a chip contains the interconnected components: the clock; a control unit comprising the program counter, the instruction register, process status word, and stack pointer; a control memory; a bus control; a working register; an arithmetic/logic unit; and an internal memory or stack. Chip 19 may be a transducer.

The conductive metals known to be useful in coaxial signal cables are useful in this invention. The insulation of the cable may be any useful insulation (dielectric), but a foamed or expanded insulation, especially of ePTFE, is preferred for the cable used in this invention. The jacket may be of a material common in wire and cable manufacture, such as a thermoplastic fluorocarbon resin, polyethylene, polypropylene, polyurethane, or rubber, for example.

The assemblies of the invention are easily manufactured by the processes of the invention, are very light in weight, have a minimum cross-section, virtually the same as that of the coaxial cable used to make the assemblies, is very strong, and provides a minimum of protruding parts outside the surface contours of the coaxial cable. Easy and rapid connection and termination to a branch coaxial cable, transducers or microchips are provided. The assembly is useful in towed underwater sensors, such as those used in sonar arrays, and other areas of application include industrial sequence controllers, machine tool controllers, point-of-sale terminals, intelligent terminals, instrument processes, traffic light controllers, weather and seismic data collection systems, and process controllers.

I claim:

1. A coaxial cable side tap assembly comprising:

(a) an electric cable comprising an electrically conductive center conductor surrounded by insulation, said insulation having a short section removed from around said center conductor;

(b) a cylindrically curved plastic cap of the same curvature as said insulation fitted over said cable at the point of removal of said short section of insulation;

(c) said cap having imbedded therein and penetrating it perpendicularly a first electric contact pin, the inside end of which pin is notched to fit over said center conductor, and which notch is soldered to said center conductor;

(d) said cap having a plastic hump molded about said first contact pin on the outside surface of said cap to aid in holding said pin in place in said cap and to aid in deflecting strands of conductive braid wire around and out of electrical contact with said first pin;

(e) said cap having affixed to its outer surface a second electrical contact pin for electrically contacting a conductive braided sheath surrounding said insulation and said cap and optionally an area of conductive metal plating on the outside surface of said cap surrounding said second pin;

(f) insulation comprising the same or different insulation to that of the insulation surrounding said conductor filling the removed section of insulation surrounding said center conductor and surrounding said first pin soldered to said center conductor;

(g) a conductive braided sheath surrounding said insulation and said cap; and (h) an optional protective polymer Jacket surrounding said conductive braid.

2. An assembly of claim 1 wherein said insulation surrounding said center conductor comprises expanded polytetrafluoroethylene.

3. A process for manufacture of a coaxial cable side tap assembly comprising the steps of:

(a) removing a specified segment of insulation from an insulated electrically conductive center conductor;

(b) placing thereon over the cavity formed by removal of said segment of insulation a cylindrically curved plastic cap of the same curvature as said insulation;

(c) said cap having imbedded therein and penetrating it perpendicularly a first electric contact pin, the inside end of which pin is notched to fit over said center conductor;

(d) said cap having a plastic hump molded about said first contact pin on the outside surface of said cap to aid in holding said pin in place in said cap and to aid in deflecting strands of conductive wire braid around and out of electrical contact with said first pin;

(e) said cap having affixed to its outer surface a second electrical contact pin for electrically contacting a conductive braided sheath surrounding said insulation and said cap and an area of optional conductive metal plating on the outside surface of said cap surrounding said second pin;;

(f) soldering said notch of said first pin to said center conductor;

(g) filling the cavity created by removal of insulation surrounding said center conductor with the same or different insulation as that surrounding said center conductor and surrounding said soldered notch, said first pin, and said center conductor;

(h) braiding a conductive sheath around said insulation surrounding said center conductor and said cap; and (i) optionally surrounding said conductive braid with a protective polymer jacket.

4. An assembly of a coaxial cable side tap assembly with a microchip comprising:

(a) a coaxial cable side tap assembly further comprising:

(i) an electrical cable comprising an electrically conductive center conductor surrounded by insulation, said insulation having a short section removed from around said center conductor;

(ii) a cylindrically curved plastic cap of the same curvature as said insulation fitted over said cable at the point of removal of said short section of insulation;

(iii) said cap having imbedded therein and penetrating it perpendicularly a first electrical contact pin, the inside end of which pin is notched to fit over said center conductor, and which notch is soldered to said center conductor;

(iv) said cap having a plastic hump molded about said first contact pin on the outside surface of said cap to aid in holding said pin in place in said cap and to aid in deflecting strands of conductive braid wire around and out of electrical contact with said first pin;

(v) said cap having affixed to its outer surface a second electrical contact pin for electrically contacting a conductive braided sheath surrounding said insulation and said cap and an area of optional conductive metal plating on the outside surface of said cap surrounding said second pin;

(vi) insulation comprising the same or different insulation to that of the insulation surrounding said conductor filling the removed section of insulation surrounding said center conductor and surrounding said first pin soldered to said center conductor;

(vii) a conductive braided sheath surrounding said insulation and said cap;

(b) an integrated circuit or transducer microchip in electrical contact with said first and second electrical contact pins; and (c) optionally a protective polymer jacket enclosing said side tap assembly and said microchip.

5. An assembly of claim 4 wherein said insulation surrounding said center conductor comprises expanded polytetrafluoroethylene.

6. A process for assembly of a coaxial side tap assembly with a microchip comprising the steps of:

(a) removing a specified segment of insulation from an insulated electrically conductive center conductor;

(b) placing thereon over the cavity formed by removal of said segment of insulation a cylindrically curved plastic cap of the same curvature as said insulation;

(c) said cap having imbedded therein and penetrating it perpendicularly a first electric contact pin, the inside end of which pin is notched to fit over said center conductor;

(d) said cap having a plastic hump molded about said first contact pin on the outside surface of said cap to aid in holding said pin in place in said cap and to aid in deflecting strands of conductive wire braid around and out of electrical contact with said first pin;

(e) said cap having affixed to its outer surface a second electrical contact pin for electrically contacting a conductive braided sheath surrounding said insulation and said cap and an area of optional conductive metal plating on the outside surface of said cap surrounding said second pin;

(f) soldering said notch of said first pin to said center conductor;

(g) filling the cavity created by removal of insulation surrounding said center conductor with the same or different insulation as that surrounding said center conductor and surrounding said soldered notch, said first pin, and said center conductor;

(h) braiding a conductive sheath around said insulation surrounding said center conductor and said cap;

(i) affixing in electrical contact with said first and second electrical contact pins an integrated circuit or transducer microchip; and (j) optionally surrounding said coaxial side tap assembly and said microchip with a protective polymer jacket.

* * * * *